US006907211B2

(12) United States Patent
Yoshida et al.

(10) Patent No.: US 6,907,211 B2
(45) Date of Patent: Jun. 14, 2005

(54) IMAGE FORMING APPARATUS

(75) Inventors: Masahiro Yoshida, Chiba (JP); Junichi Kato, Chiba (JP); Yasushi Shimizu, Ibaraki (JP); Hiroshi Sato, Ibaraki (JP); Hiroyuki Oba, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 731 days.

(21) Appl. No.: 09/900,044

(22) Filed: Jul. 9, 2001

(65) Prior Publication Data

US 2004/0202494 A1 Oct. 14, 2004

(30) Foreign Application Priority Data

Jul. 12, 2000 (JP) ..... 2000-210984

(51) Int. Cl.[7] ..... G03G 15/30
(52) U.S. Cl. ..... 399/149; 399/150
(58) Field of Search ..... 399/130, 148, 399/149, 150, 159, 111

(56) References Cited

U.S. PATENT DOCUMENTS 5,587,774 A * 12/1996 Nagahara et al. ..... 399/176
5,970,285 A * 10/1999 Ito et al. ..... 399/149
6,002,900 A * 12/1999 Ishiyama ..... 399/149
6,128,456 A * 10/2000 Chigono et al. ..... 399/176
6,134,407 A 10/2000 Ishiyama et al. ..... 399/174
6,366,751 B1 * 4/2002 Shakuto et al. ..... 399/159

FOREIGN PATENT DOCUMENTS

JP 10-307454 11/1998

* cited by examiner

*Primary Examiner*—Hoan Tran
(74) *Attorney, Agent, or Firm*—Fitzpatrick, Cella, Harper & Scinto

(57) ABSTRACT

An image forming apparatus is provided, which includes: an image bearing member, a charging member for charging the image bearing member, the charging member bearing electrically conductive particles that contact the image bearing member, and a developer carrying member for carrying a developer provided with toner and electrically conductive particles, the developer carrying member being applied a voltage to develop an electrostatic image formed on the image bearing member with the developer and being capable of collecting a residual developer on the image bearing member, wherein the developer carrying member is provided in such a manner that the developer carrying member opposes the image bearing member via a gap of 150 $\mu$m or more and 250 $\mu$m or less.

13 Claims, 9 Drawing Sheets

IMAGE FORMING APPARATUS

BACKGROUND OF THE INVENTION

1. Field of the Invention

The present invention relates to an image forming apparatus such as a copying machine and a printer employing an electrophotographic method.

2. Related Background Art

FIG. 9 is a schematic sectional view showing an example of a conventional image forming apparatus.

Such an image forming apparatus has a photosensitive drum 1 being a latent image bearing member, a charging roller 2 being a charging member employing a so-called contact charging method, a developing means 3, a cleaning device 5 and a fixing means 9.

In such an image forming apparatus, the charging roller 2 to which a voltage (e.g., a direct current voltage, a superimposed voltage of a direct current voltage and an alternate current voltage, or the like in the order of 1 to 2 kV) is applied from a power source 21 is caused to contact the surface of the photosensitive drum 1 as a charged member, whereby the surface of the photosensitive drum 1 is charged to have a predetermined potential ($V_d$).

Then, in accordance with the rotation (in an arrow a direction in the figure) of the photosensitive drum 1, a laser beam L1 emitted from an exposing means 8*a* is irradiated on the photosensitive drum 1 that is charged as described above via an exposing window 6*a*, whereby an electrostatic latent image is formed on the photosensitive drum 1.

In addition, a non-magnetic developing sleeve 3*a* being a developer carrying member, which is arranged in an opening part provided on the photosensitive drum 1 side of the developing means 3 and fixedly encloses a magnet roll 3*c* having a plurality of N and S poles, takes toner form an S2 pole being a toner capturing pole to carry it and rotates in an arrow b direction in the figure. Toner on the developing sleeve 3*a* is regulated by a toner layer thickness regulating member 3*b* and given predetermined triboelectricity to be coated in a predetermined amount. The developing means 3 is provided with rollers 209 at both ends in an axial direction of the developing sleeve 3*a* as shown in FIG. 12. As the rollers 209 contact the photosensitive drum 1, a predetermined gap is formed between the developing sleeve 3*a* and the photosensitive drum 1. When a voltage (e.g., a superimposed voltage of a direct current voltage and an alternating current voltage) from the power source 31 is applied to the developing sleeve 3*a*, toner performs a so-called jumping phenomenon and reversely develops an electrostatic latent image on the photosensitive drum 1 to visualize it as a toner image.

On the other hand, a transferring material P being a recording medium such as paper is contained in a sheet feeding cassette 117, fed by a sheet feeding roller 118 and synchronized with the toner image on the photosensitive drum 1 by a registration roller (not shown) to be conveyed onto a transferring roller 4.

Toner images on the photosensitive drum 1 are transferred one after another onto the transferring material P that is synchronized with the rotation of the transferring roller 4 provided in an image forming apparatus main body and conveyed.

The transferring material P on which the above-mentioned toner image is transferred is separated from the surface of the photosensitive drum 1, conveyed to a fixing means 9 provided in the image forming apparatus main body, fixed the above-mentioned toner image thereon, and discharged to the outside of the image forming apparatus main body.

On the other hand, transfer residual toner that has not been transferred and remains on the photosensitive drum 1 is removed by a cleaning blade 5*a* inside the cleaning device 5. The surface of the photosensitive drum 1 from which the transfer residual toner is removed is charged by the charging roller 2 again and served to the above-mentioned process.

As described above, in an image forming apparatus of a transferring method, transfer residual toner remaining on a photosensitive drum after transfer is removed from the surface of the photosensitive drum by a cleaner (cleaning device) to be waste toner. It is preferable that this waste toner is never produced from the viewpoint of environmental protection.

Thus, in a conventional image forming apparatus, an image forming apparatus of a toner recycling process has also been developed which has a configuration for removing transfer residual toner on a photosensitive drum after transfer with the "cleaning simultaneous with developing" by a developing apparatus without a cleaner and collecting the transfer residual toner in the developing apparatus to recycle it.

The cleaning simultaneous with developing is a method of forming a latent image by charging and exposing a photosensitive drum at the time of development in the next and subsequent steps, that is, continuously, and collecting toner remaining on a photosensitive drum after transfer by a fog eliminating bias (a fog eliminating bias $V_{back}$ that is a potential difference between a direct current voltage applied to a developing apparatus and a surface potential of the photosensitive drum) when the latent image is developed. According to this method, since the residual toner is collected in the developing apparatus and recycled in the next and subsequent steps, waste toner can be eliminated and labor required for maintenance can be reduced. In addition, since the image forming apparatus does not use a cleaner, the image forming apparatus has a significant advantage in terms of space and can be substantially miniaturized.

In addition, conventionally, there is known two types of charging mechanisms of (1) a discharge charging mechanism and (2) a direct injection charging mechanism as a charging mechanism (a mechanism of charging, a charging theory) of contact charging. Each of the charging mechanisms has advantages and disadvantages compared with the other.

(1) Discharge Charging Mechanism

This is a mechanism of charging a surface of a body to be charged by a discharge phenomenon that occurs at a very small gap between the body to be charged and a charging member for contacting the body to be charged to charge the body to be charged (hereinafter referred to as a contact charging member). Since the discharge charging mechanism has constant discharge threshold value in the contact charging member and the body to be charged, it is necessary to apply a voltage larger than a charging potential to the contact charging member. In addition, although a generated amount of ozone is markedly less than that of a corona charger, it is principally inevitable that a discharge products is generated. Moreover, there may also be a problem in that substances in a generated discharge product and a transferring material act each other to hinder formation of a latent image, that is a problem called "smeared image".

(2) Direct Injection Charging Mechanism

This is a system in which a charge is directly injected in a body to be charged from a contact charging member, whereby the surface of the body to be charged is charged. This is also referred to as a direct charging, an injection charging or a charge injection charging. More specifically, this mechanism is for causing a contact charging member of a medium resistance to contact a surface of a body to be charged and directly injecting a charge in the surface of the body to be charged not via a discharge phenomenon, that is without basically using discharge. Thus, even if a voltage applied to the contact charging member is less than a discharge threshold value, the body to be charged can be charged to a potential equivalent to the applied voltage.

In this way, with the direct injection charging mechanism, there is a significant advantage in that an adverse influence due to a discharge product does not occur because it does not involve generation of an ion. Thus, various patent applications have been filed in the past for the direct injection charging mechanism. For example, in Japanese Patent Application Laid-open No. 10-307454, it is proposed to cause electrically conductive particles to intervene between a charging member and a photosensitive drum. In this application, as shown in FIG. 10, electrically conductive particles supplying means 42 is provided on the upstream side of a charging roller 2, and the electrically conductive particles are supplied between the charging roller 2 and a photosensitive drum 1, whereby the direct discharging mechanism is realized.

In addition, an example of using the direct injection charging mechanism to realize a cleanerless system is disclosed in Japanese Patent Application Laid-open No. 10-307455. According to the application, this system is realized by actions described below.

Electrically conductive fine particulate matters having conductivity that are contained in a developer of developing means are transferred to the side of a latent image bearing member in an appropriate amount together with toner at the time of toner development of an electrostatic latent image on the side of the latent image bearing member by the developing means.

A toner image on the latent image bearing member is pulled by an influence of a transfer bias and actively transfers to the side of a transferring material in a transferring portion of transferring means. However, the electrically conductive fine particulate matters on the latent image bearing member do not actively transfer to the side of the transferring material because they are electrically conductive, and are substantially deposited and held on the latent image bearing member to remain there.

In addition, since the image forming apparatus of the toner recycle process does not use a cleaner, transfer residual toner remaining on the circumference surface of the latent image bearing member after transfer and the above-mentioned residual electrically conductive fine particulate matters are carried to a contacting part of the latent image bearing member and the contact charging member as they are with the movement of the circumference surface of the latent image bearing member and deposited and mixed in the contact charging member.

Therefore, contact discharging of the latent image bearing member is performed in the state in which the electrically conductive fine particulate matters exist in the contacting part of the latent image bearing member and the contact charging member.

Due to the existence of the electrically conductive fine particulate matters, even if toner is deposited and mixed in the contact charging member, precise contacting nature of the contact charging member with the latent image bearing member and a contacting resistance can be maintained. Thus, it is possible to configure the image forming apparatus using a simple member such as a charging roller or a fur brush as the contact charging member. Moreover, direct injection charging of the latent image bearing member by the contact charging member is possible regardless of contamination of the contact charging member due to transfer residual toner.

That is, the contact charging member closely contacts the latent image bearing member via the electrically conductive fine particulate matters, and the electrically conductive fine particulate matters existing in the contacting part of the contact charging member and the latent image bearing member are rubbed between the contact charging member and the surface of the latent image bearing member without any space. Thus, charging of the latent image bearing member by the contact charging member is predominated by the direct injection charging that is stable and safe without using discharge phenomenon due to the existence of the electrically conductive fine particulate matters, and a high charging efficiency can be attained that has not been attained in the conventional roller charging or the like, whereby a potential substantially equivalent to a voltage applied to the contact charging member can be given to the latent image bearing member.

In addition, the transfer residual toner deposited and mixed in the contact charging member is gradually discharged onto the latent image bearing member from the contact charging member to reach the developing portion with the movement of the circumference surface of the latent image bearing member and cleaned simultaneously with being developed (collected) in the developing means (the toner recycle process).

Moreover, even if the electrically conductive fine particulate matters fall from the contact charging member, the image forming apparatus is activated, whereby the electrically conductive fine particulate matters contained in the developer of the developing means transfer to the circumference surface of the latent image bearing member in the developing portion and are carried to the charging portion through the transferring portion by the movement of the circumference surface of the image bearing member to be continuously supplied to the contact charging member sequentially. Thus, the favorable chargeability due to the existence of the electrically conductive fine particulate matters is steadily maintained.

Therefore, in the image forming apparatuses of the contact charging method, the transferring method and the toner recycle process, a simple member such as a charging roller and a fur brush is used as a contact charging member, whereby ozoneless direct injection charging can be steadily maintained for a long period under a low applied voltage regardless of contamination of the contact charging member by transfer residual toner.

The above-mentioned proposals realize a uniform electricity charging property of a surface of a latent image bearing member by the above-mentioned actions and are effective with respect to environmental protection and miniaturization of an apparatus in terms of realizing toner recycling, simply configured and low cost image forming apparatuses without faults due to an ozone product, a charging defect or the like.

However, in the conventional image forming apparatus, if the configuration disclosed in Japanese Patent Application Laid-open No. 10-307454 is used, it is likely that a predetermined $V_d$ is not obtained on a photosensitive drum and a charging defect is caused.

According to studies of researchers or inventors, occurrence of a charging defect was caused by an insufficient absolute amount of electrically conductive fine particulate matters on a charging roller, and the image forming apparatus employed a mechanism for supplementing the fall of the electrically conductive fine particulate matters from a contact charging member by the supply of new electrically conductive fine particulate matters by developing apparatus. Thus, a supply amount of the electrically conductive fine particulate matters by the developing means was not enough in some cases. As a result, an absolute amount of the electrically conductive fine particulate matters on the charging roller used to be insufficient. The researchers further investigated factors for this and found it was a major factor that an amount of electrically conductive fine particulate matters flying on the photosensitive drum 1 from the developing sleeve 3*a* was not enough. This will be described with reference to FIG. 11.

FIG. 11 is an enlarged model view of a cross section of a gap part between a developing apparatus in which the above-mentioned charging defect has occurred and a photosensitive drum (hereinafter referred to as an S-D gap part).

In the configuration shown in FIG. 11, toner is charged to have a negative polarity and reversely developed in a latent image portion. Electrically conductive fine particulate matters as additives are charged to have a positive polarity, and some of them are served for development in a latent image portion on a photosensitive drum while it sticks to the toner, and some are removed from the toner and flown to a non-image portion on the photosensitive drum to deposit there. That is, as shown in FIG. 2, a developing bias that is a direct current (indicated by $V_{dc}$ in FIG. 2) superimposed with an alternating current voltage is applied to a developing sleeve. The electrically conductive fine particulate matters sticking to the toner is flown onto a portion with a latent image potential $V_1$ on the photosensitive drum by an alternating current voltage $V_{max}$ in accordance with a contrast of $|V_{max}-V_1|$. The electrically conductive fine particulate matters removed from the toner are flown onto a portion with a non-image potential $V_d$ by an alternating current voltage $V_{mix}$ according to the contrast $|V_{min}-V_1|$ (hereinafter referred to as a "electrically conductive fine particulate matter flying bias"). The electrically conductive fine particulate matters are also supplied to a non-image portion on the photosensitive drum by these actions, whereby conductivity of a charging roller is maintained.

In addition, FIG. 11 schematically shows a situation in which a bias in the direction of flying the electrically conductive fine particulate matters to the non-image portion on the photosensitive drum (a bias in the direction of not flying the toner to the latent image portion) is applied to the developing sleeve and electrically conductive fine particulate matters 41 removed from the toner are being flown to the non-image portion on the photosensitive drum.

Further, when te bias shown in FIG. 11 is applied, the electrically conductive fine particulate matters are flown only when $F_1>F_2$, where $F_1$ is a force prompting the electrically conductive fine particulate matters to be removed and flown from the toner and $F_2$ is a force of the electrically conductive fine particulate matters sticking to the toner. Therefore, the following description is limited to the flown electrically conductive fine particulate matters.

The electrically conductive fine particulate matters 41 shown in FIG. 11 are charged to have a positive polarity mainly by the rubbing against the toner. However, since not all the electrically conductive fine particulate matters rub with the toner in the same manner, different electrically conductive fine particulate matters have different triboelectricity.

Electrically conductive fine particulate matters 41*a*, 41*b* and 41*c* shown in FIG. 11 are electrically conductive fine particulate matters having different triboelectricity, respectively.

The electrically conductive fine particulate matters 41 has lower triboelectricity in the following order: the electrically conductive fine particulate matter 41*a*>the electrically conductive fine particulate matter 41*b*>the electrically conductive fine particulate matter 41*c*.

Here, the toner and the electrically conductive fine particulate matters are flown with a fly prompting force $F_1=ma$ that is a product of a mass m and an acceleration a according to a bias applied to the developing sleeve. At this point, $F_1$ can also be represented as $F_1=qE$ using a product of an electric field intensity E generated by the applied bias and a charge quantity q that the toner and the electrically conductive fine particulate matters have.

In addition, a distance L that the toner and the electrically conductive fine particulate matters are flown (hereinafter simply referred to as a fly amount L) is represented by the following expression when a time during which the electric field intensity E for flying them by the applied bias is applied is t.

$$L=(1/2)\times at^2$$

When a is found from the above-mentioned two expressions for prompting flying, $a=(q/m)\times E$ because $ma=qE$. Here, (q/m) is so-called triboelectricity.

That is, it is seen that the flying amount L of the toner and the electrically conductive fine particulate matters is proportional to each value of triboelectricity of the toner and the electrically conductive fine particulate matter.

Therefore, as shown in FIG. 11, the flying amount L of the electrically conductive fine particulate matters becomes smaller in the following order: the electrically conductive fine particulate matter 41*a*>the electrically conductive fine particulate matter 41*b*>the electrically conductive fine particulate matter 41*c*.

That is, when the configuration of FIG. 11 is used, although electrically conductive fine particulate matters corresponding to the electrically conductive fine particulate matter 41*a* can reach the surface of the photosensitive drum, those corresponding to the electrically conductive fine particulate matter 41*b* or the electrically conductive fine particulate matter 41*c* are less likely to reach the surface of the photosensitive drum. As a result, the supply of toner and electrically conductive fine particulate matters to the charging roller 2 is insufficient and charging defaults occur.

Here, as means for increasing the flying force of the electrically conductive fine particulate matters 41, there is a method of increasing the electric field intensity E. The electric field intensity E is represented as E=V/d, where V is an electrically conductive fine particulate matter flying bias, d is an S-D gap. That is, the electric field intensity E can be increased simply by changing the electrically conductive fine particulate matter flying bias or the S-D gap that is an element of the electric field intensity, whereby the flying force of the electrically conductive fine particulate matters 41 can be increased.

Therefore, experiments were conducted by increasing $V_{pp}$ of an alternating current voltage of the developing bias to make the electrically conductive fine particulate matter flying bias larger or simply making the S-D gap smaller to increase the electric field intensity E. Then, although a $V_d$ maintenability for maintaining a predetermined $V_d$ was improved, a defective image due to a bias leakage of the developing bias onto the photosensitive drum (hereinafter referred to a "leak image") occurred, in particular, under a low atmospheric pressure in the order of 525 mHg.

Here, a relation between the leak image and the electric field intensity E was examined under the atmospheric pressure of 525 mHg, and it was found that there was a relation as shown in FIG. 13. It is seen from FIG. 13 that both the large electrically conductive fine particulate matter flying bias and the small S-D gap those increased the electric field intensity tend to cause a leak image. That is, when a tolerance of the developing bias, the S-D gap or the like is taken into consideration, it is not very favorable to simply increase the electric field intensity because it makes a margin with respect to the occurrence of a leak image smaller.

SUMMARY OF THE INVENTION

It is an object of the present invention to provide an image forming apparatus in which electrically conductive particles can be steadily supplied from a developer carrying member to an image bearing member.

It is another object of the present invention to provide an image forming apparatus in which leakage from a developer carrying member to an image bearing member is prevented.

It is another object of the present invention to provide an image forming apparatus in which a charging defect of an image bearing member due to insufficient electrically conductive particles born by a charging member is prevented.

It is yet another object of the present invention to provide an image forming apparatus in which an amount of electrically conductive particles to be flown from a developer carrying member to an image bearing member is made proper, whereby an amount of conducive particles conveyed from the image bearing member to a charging member is made proper.

Other features and advantages of the present invention will be more apparent from the following description taken in conjunction with the accompanying drawings.

DETAILED DESCRIPTION OF THE PREFERRED EMBODIMENTS

Embodiments of the present invention will be hereinafter described with reference to the accompanying drawings.

[First Embodiment]

First, a first embodiment of the present invention will be described.

Figure 1:
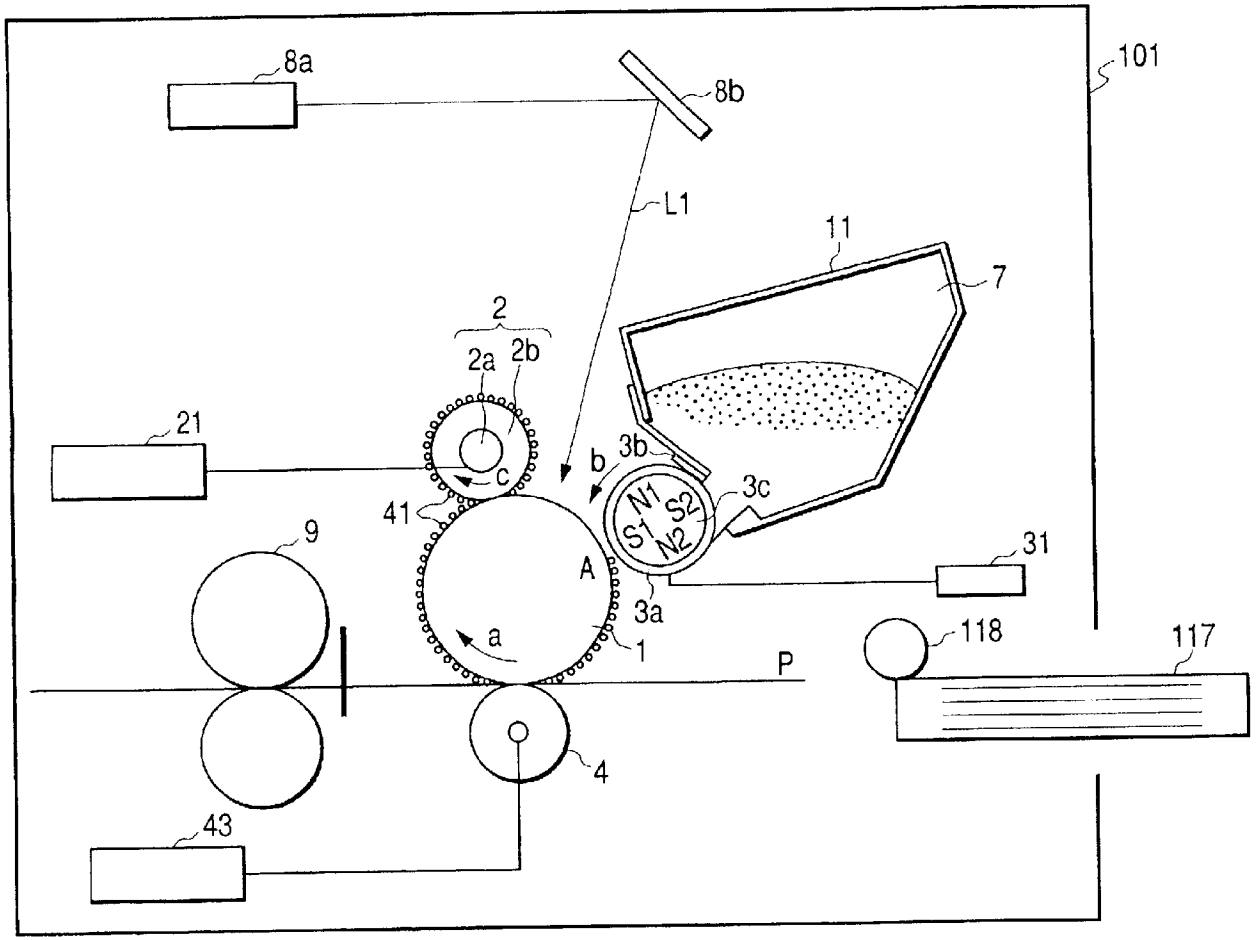
FIG. 1 is a schematic sectional view showing a configuration of an image forming apparatus in accordance with a first embodiment of the present invention.

FIG. 1 is a schematic sectional view that best shows characteristics of an image forming apparatus in accordance with this embodiment.

As shown in FIG. 1, such an image forming apparatus is provided with a photosensitive drum 1 being a latent image bearing member, a charging roller 2 being a charging member, exposing means 8*a*, a developing apparatus 11 being developing means, a transferring roller 4 being transferring means and fixing means 9.

The charging roller 2 in accordance with this embodiment is applied electrically conductive fine particulate matters being conducting particles on its surface in advance in an initial period before a user uses it. Thus, since the electrically conductive fine particulate matters exists between the photosensitive drum 1 and the charging roller 2 even in the initial period, the surface of the photosensitive drum 1 can be uniformly charged to a dark potential ($V_d$) in the order of −500 V by contacting the charging roller 2, to which a voltage (a direct current voltage of −520 V) from a power source 21, with the photosensitive drum 1.

Figure 9:
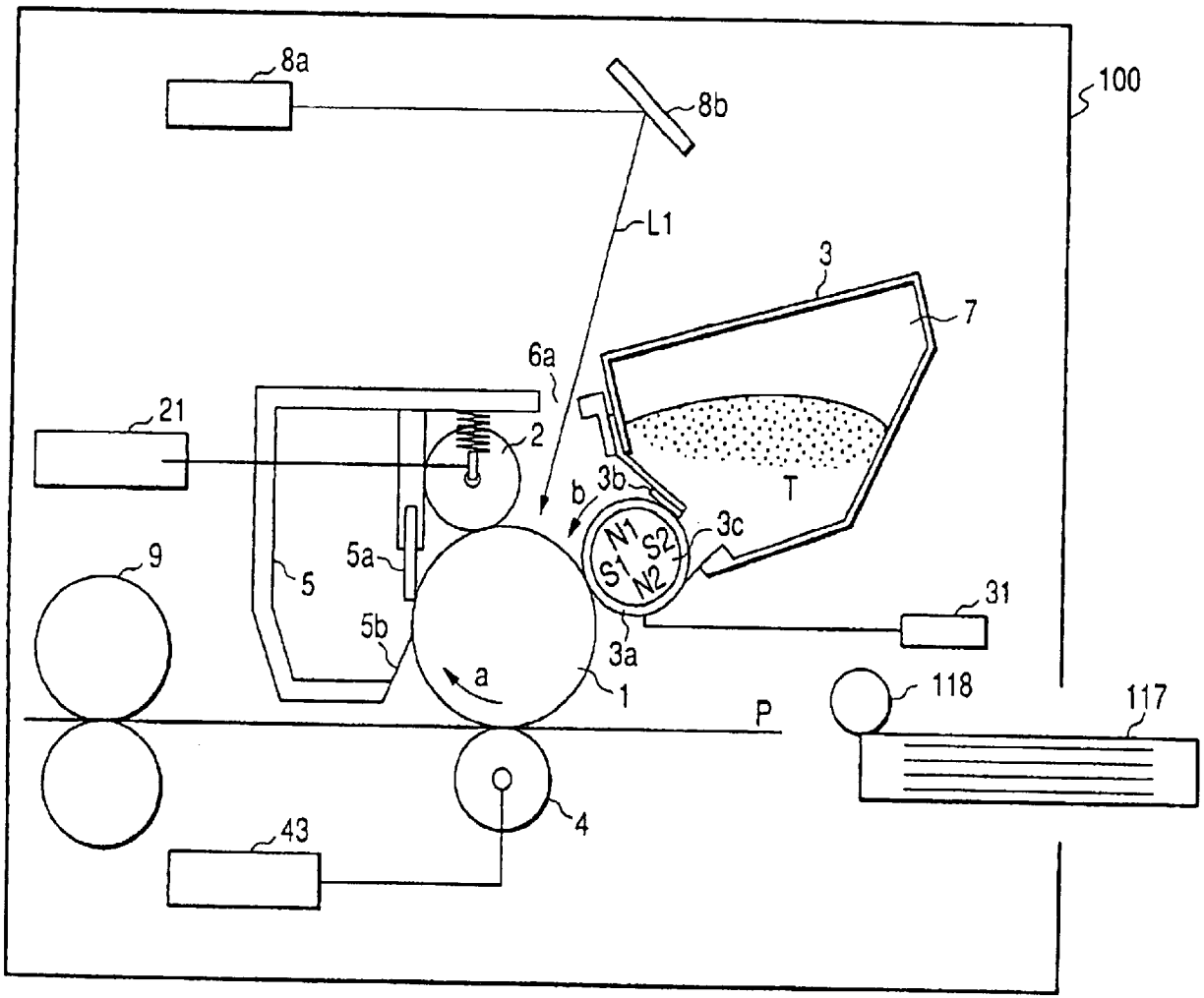
FIG. 9 PRIOR ART
FIG. 9 is a schematic sectional view showing a configuration of a conventional image forming apparatus.
Figure 10:
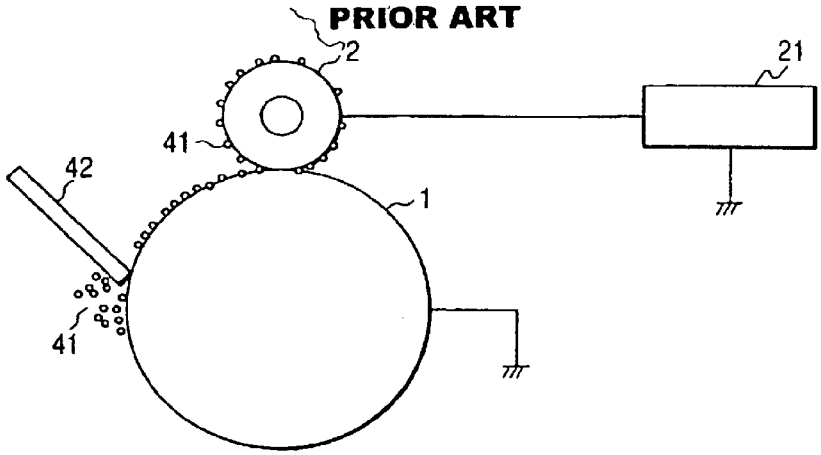
FIG. 10 PRIOR ART
FIG. 10 is a schematic view for illustrating a mechanism for applying conducive particles to a latent image bearing member in another conventional image forming apparatus.

In a conventional example shown in FIG. 9, a surface of a photosensitive drum is steadily charged by usually applying a superimposed voltage of a direct current voltage and an alternating current voltage to a charging roller to prevent an image defect such as sands (a phenomenon in which toner is flown on a white ground due to a charging defect). However, as described before, it is theoretically inevitable that a discharge product is generated in such a discharge charging mechanism. On the other hand, in this embodiment, since only a direct current voltage is applied to the charging roller 2, the surface of the photosensitive drum 1 can be charged without generating a discharge product.

The charging roller 2 will now be described in detail.

The charging roller 2 is made by forming a medium resistance layer 2*b* of rubber or a foam being a flexible member on a core metal 2*a*. The medium resistance layer 2*b* is made by being processed with resin (e.g., urethane), electrically conductive particles (e.g., carbon black), a sulfidizing agent, a foaming agent or the like, formed in a roller shape on the core metal 2*a* and ground on its surface if necessary. In addition, a rotating direction c of the charging roller 2 is a counter direction with respect to a rotating direction a of the photosensitive drum 1 in a nip portion of the charging roller 2 and the photosensitive drum 1. The charging roller 2 is rotated at a speed of 150% in a peripheral velocity difference with respect to a peripheral velocity of the photosensitive drum 1, whereby many of the electrically conductive fine particulate matters existing on the photosensitive drum 1 are scraped off. Thus, the electrically conductive fine particulate matters supplied from a developing sleeve 3*a* to be described later can be applied on the charging roller 2. In addition, direct injection charging is realized by the existence of the electrically conductive fine particulate matters between the charging roller 2 and the photosensitive drum 1.

In such an image forming apparatus, a laser beam L1 emitted from exposing means 8*a* is irradiated on the photosensitive drum 1, which is charged as described above, via a reflecting member 8*b*, whereby a latent image is formed on the photosensitive drum 1. At this point, a surface potential (light potential) of the photosensitive drum 1 in the case in which the laser beam L1 is uniformly irradiated on the photosensitive drum 1 is set as $V_L$=−100 V.

The developing apparatus 11 is disposed opposing the photosensitive drum 1 and composed of a toner container 7 as a developer container for containing toner T being a developer, a developing sleeve 3*a* being a developer carrying member spaced apart a predetermined gap amount with respect to the photosensitive drum 1, a toner layer thickness regulating member 3*b*, a magnet roll 3*c* enclosed in the developing sleeve 3*a*, a power source 31 for supplying power to a core metal of the developing sleeve 3*a* and the like.

As the developing sleeve 3*a*, an aluminum element pipe which is applied a coating agent and given an appropriate roughness is used. This developing sleeve 3*a* receives a driving force from a gear (not shown) of the photosensitive drum 1 to rotate in a forward direction (b) with respect to a rotating direction (a) of the photosensitive drum 1 in a developing portion and carries the toner T containing the electrically conductive fine particulate matters inside the toner container 7 to the photosensitive drum 1.

In this embodiment, plate-shaped urethane rubber is used as the toner layer thickness regulating member 3*b* for regulating and charging the toner on the developing sleeve 3*a*. In addition, in this embodiment, a superimposed voltage of a predetermined alternating current voltage and a direct current voltage of −400 V is applied to the developing sleeve 3*a* from the power source 31, whereby a latent image on the photosensitive drum 1 is visualized with the toner carried by the developing sleeve 3*a*.

Thereafter, toner images on the photosensitive drum 1 is transferred one after another onto a transferring material P being a recording member such as paper conveyed in synchronous with the rotation of the transferring roller 4 provided on an image forming apparatus main body 101. The transferring material P to which the toner image is transferred is separated from the surface of the photosensitive drum 1 and conveyed to the fixing means 9 provided in the image forming apparatus main body 101, where the toner image is fixed on the transferring material P.

The image forming apparatus main body 101 of this embodiment employs a cleanerless method that does not have a cleaner for cleaning transfer residual toner of the photosensitive drum 1. The transfer residual toner remaining on the surface of the photosensitive drum 1 after transferring a toner image to the transferring material P reaches a developing portion A via the position of the charging roller 2 in accordance with the rotation of the photosensitive drum 1 without being removed by a cleaner and is cleaned (collected) simultaneously with being developed by the developing sleeve 3*a* (a toner recycle process). That is, the photosensitive drum 1 is charged by the charging roller 2 with the transfer residual toner remaining on the photosensitive drum 1 and, after being exposed by exposing means to be formed a latent image thereon, a light portion of the latent image is developed with a developer by the developing sleeve 3*a*, and at the same time, the developer is returned from a dark portion of the latent image to the developing sleeve 3*a*.

In this embodiment, a toner nucleus body is formed of styrene resin, and 2 pst. wt. of silica is externally added as an additive for prompting charging of the toner and 2 pst. wt. of electrically conductive zinc oxide particles including a secondary aggregate and having a particle resistance of $10^6$ Ωcm and an average particle diameter of 3 μm is added as electrically conductive fine particulate matters. Further, as a material of the electrically conductive fine particulate matters, various electrically conductive particle can be used such as electrically conductive inorganic particles such as other metal oxides and a mixture of inorganic particles with organic matters besides those used in this embodiment. In addition, concerning a particle resistance of the electrically conductive fine particulate matters, since charges are exchanged via particles, $10^{12}$ Ωcm or less is required as a resistivity and $10^{10}$ Ωcm or less is desired.

Figure 2:
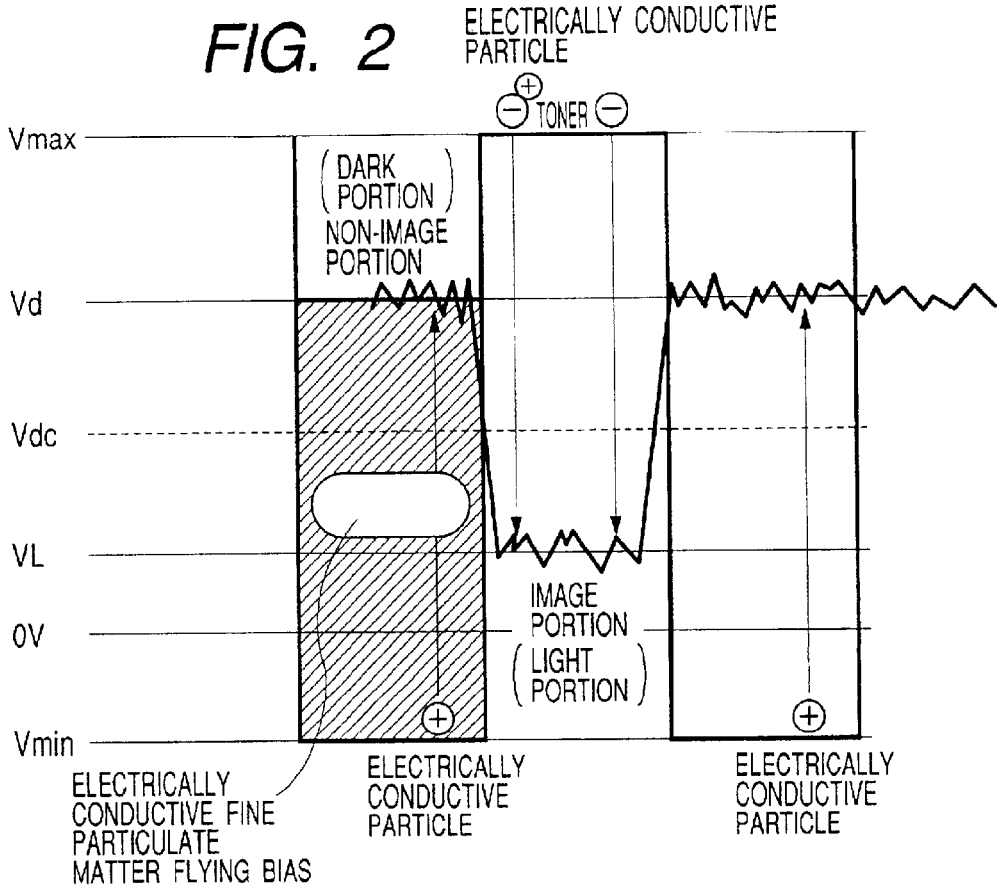
FIG. 2 is a diagram for illustrating electrically conductive particles flown from a surface of a developer carrying member to a surface of a latent image bearing member.

In this embodiment, since the electrically conductive fine particulate matters indicate a positive tendency as an additive, if, for example, an alternating current voltage of 1.2 kV is applied to the developing sleeve 3*a* as shown in FIG. 2, the electrically conductive fine particulate matters are flown from the developing sleeve 3*a* to the photosensitive drum 1 with the contrast of 700 V ($|V_{min}-V_d|=|200-(-500)|$) as an additive alone with respect to the non-image portion. In addition, some additives stick to toner, which are flown from the developing sleeve 3*a* to the photosensitive drum 1 with the contrast of 900V ($|V_L-V_{max}|=|-100-(-1000)|$) with respect to the image portion on the photosensitive drum 1.

Since the electrically conductive fine particulate matters flown to the surface of photosensitive drum 1 are positive, they remain on the photosensitive drum 1 together with transfer residual toner after transferring process. Thereafter, many of the electrically conductive fine particulate matters are scraped off by the charging roller 2 that rotates in the counter direction with respect to the photosensitive drum 1 as describe before, whereby the electrically conductive fine particulate matters can be deposited on the charging roller 2.

In this way, even if the electrically conductive fine particulate matters applied on the charging roller 2 in the initial period decreases as the number of fed sheets increases, the direct injection charging is realized by supplying the electrically conductive fine particulate matters 41 to the charging roller 2 from the developing apparatus 11 via the photosensitive drum 1.

The developing apparatus that is a characteristic of this embodiment will now be described in detail.

In this embodiment, it is a significant characteristic to realize stabilization of the supply of electrically conductive fine particulate matters from the developing sleeve by optimizing the S-D gap of the photosensitive drum and the developing sleeve.

An experiment in which the S-D gap is optimized will be described here.

Such an experiment confirmed the state of occurrence of a charging defect by changing the S-D gap 100 μm, 150 μm, 250 μm, 300 μm, 350 μm. Further, although the S-D gap was measured while rotating both the developing sleeve and the photosensitive drum here, since values of both the developing sleeve and the photosensitive drum deflect by swing or the like of an element pipe, an average value including deflections was treated as the S-D gap.

In addition, since the electric field intensity E generated between the photosensitive drum and the developing sleeve changed as described above as the S-D gap changed, a potential different was changed on occasion such that the electric field intensity E in the direction of the electrically conductive fine particulate matters being flown to the non-image portion remained the same. That is, a potential difference was changed such that an equivalent electric field intensity was always obtained by changing a electrically conductive fine particulate matter flying bias in accordance with the amount the S-D gap changed. Further, a charging defect was confirmed by a degree to which the $V_d$=−500 V in the initial period was maintained during the endurance of the fed sheets of 2000.

Figure 3:
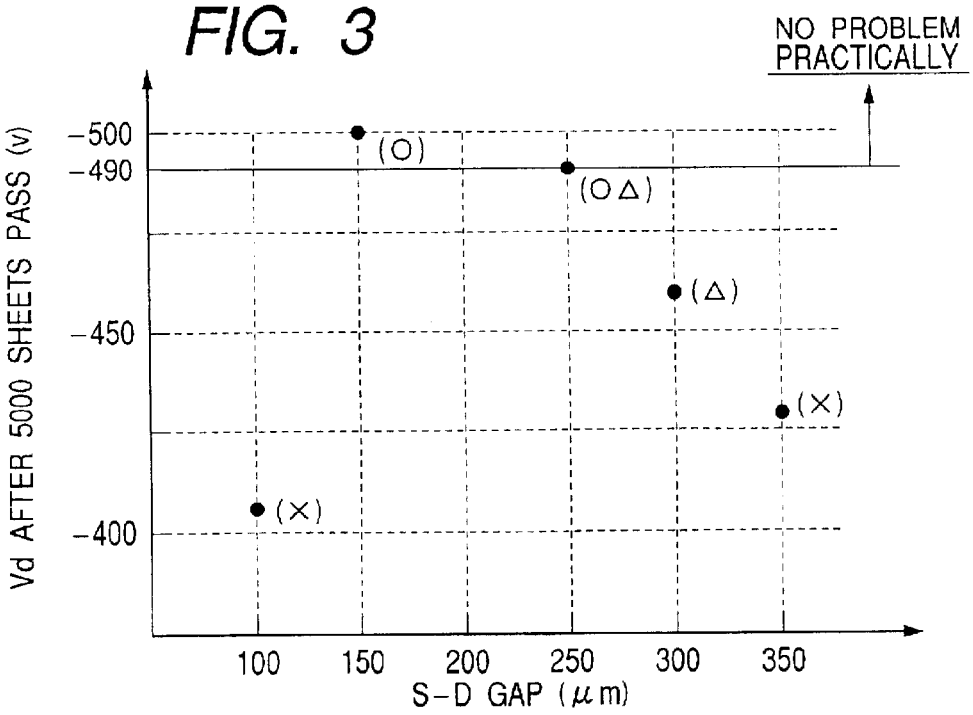
FIG. 3 is a graph showing a relation between a distance of the surface of the latent image bearing member and the surface of the developer carrying member (S-D gap) and a charging potential ($V_d$) on the surface of the latent image bearing member by a charging member in the first embodiment of the present invention.

Results of the optimization of the S-D gap according to this experiment is shown in FIG. 3.

FIG. 3 is a graph with the S-D gap (μm) on the horizontal axis and $V_d$ (V) after 2000 sheets pass on the vertical axis in which a result in each setting is plotted. A determination result is shown in parentheses beside each plotted point. A symbol ○ in the determination shown in FIG. 3 indicates the case in which there was no problem in the $V_d$ maintenability and no charge defect occurred. A symbol ○Δ indicates that the $V_d$ was not completely held but there was no problem practically. A level with no practical problem was set at −490 (V) or more. Both symbols Δ and x indicate that $V_d$ cannot be maintained and is not for practical use and that x is worse in terms of a level.

From the above-mentioned results, $V_d$ after 2000 sheets pass (hereinafter referred to as $V_d$ after endurance) is −430 V at the S-D gap of 350 μm, and $V_d$ is short −500 V by 70 V. $V_d$ after endurance is −460 V at the S-D gap of 300 μm, and $V_d$ is short of −500 V by 40V. Although $V_d$ was not maintained at −500 V at the S-D gap of 250 μm, this is a level that has no problem practically. At the S-D gap of 150 μm, $V_d$ is maintained at −500 V and has no problem. At the S-D gap of 100 μm, a variation of $V_d$ is the largest and $V_d$ is short of −500 V by 90 V.

From this result, it may be determined that the S-D gap has optimal values between 150 μm and 250 μm.

Figure 11:
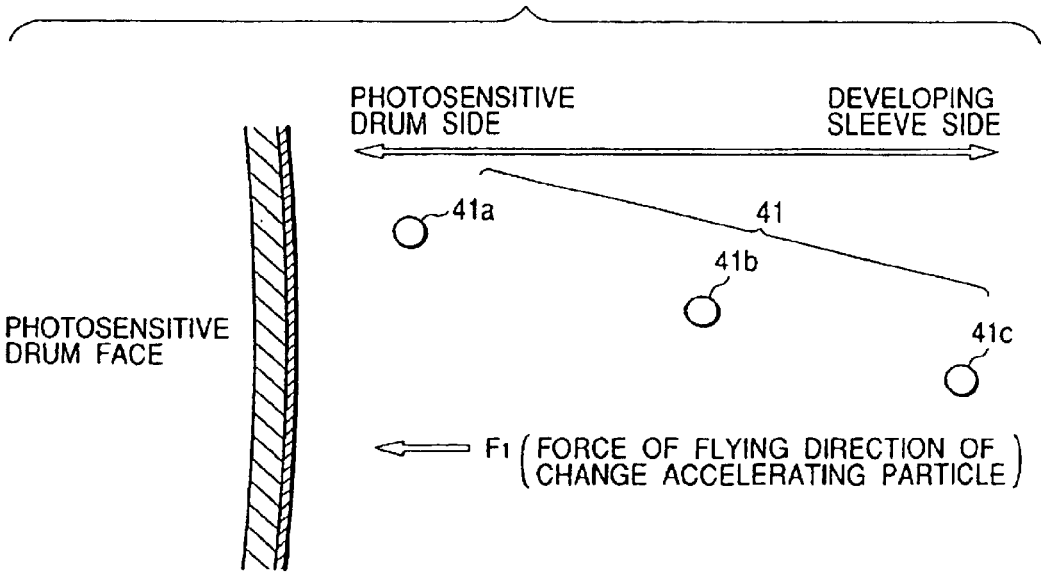
FIG. 11 is a schematic view for illustrating electrically conductive particles flown from the surface of the developer carrying member to the surface of the latent image bearing member.
Figure 12:
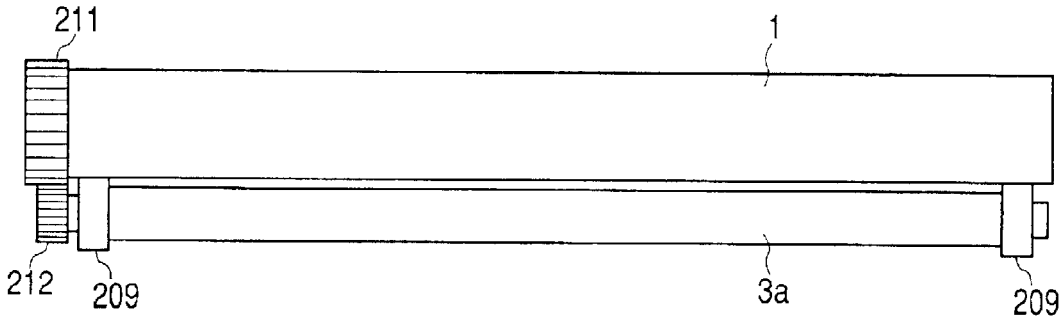
FIG. 12 is a schematic view for illustrating a closely opposing arrangement of the developer carrying member with respect to the latent image bearing member.
Figure 13:
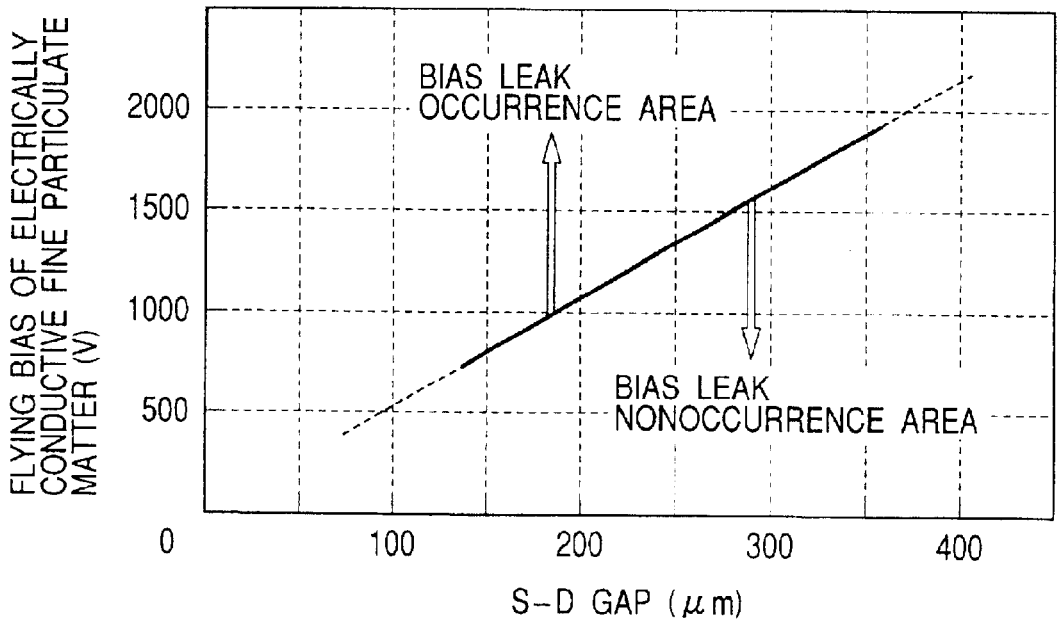
FIG. 13 is a graph for illustrating a relation among electrically conductive fine particulate matters, the S-D gap and occurrence of bias leakage.

Here, $V_d$ could not have been maintained at the S-D gap of 300 μm or more, in particular at 350 μm. It is possible that this is because, as shown in FIG. 11, the electrically conductive fine particulate matters with small triboelectricity and weak flying force did not reach the photosensitive drum in many cases because the S-D gap is wide. In addition, there was no problem in the Vd maintenability between the S-D gaps of 150 μm and 250 μm. It is possible that this is because, although the flying force of the electrically conductive fine particulate matters having each triboelectricity was unchanged, the electrically conductive fine particulate matters reached the photosensitive drum by the amount of the reduced distance, and therefore the sufficient amount of electrically conductive fine particulate matters were flown to the surface of the photosensitive drum and supplied to the charging roller sufficiently. Moreover, it is also possible that, when the transfer residual toner taken in the charging roller was discharged on the photosensitive drum, an influence of a magnetic field of the magnet roll 3*c* in the developing sleeve 3*a* became higher in accordance with the amount of a reduced distance to the S-D gap, and the collection of the discharged toner on the photosensitive drum onto the developing sleeve 3*a* also worked advantageously and was advantageous in terms of toner contamination on the discharging roller. In addition, $V_d$ could not have been maintained at the S-D gap of 100 μm. It is possible that this is because toner coated on the developing sleeve contacted the photosensitive drum directly in many cases despite the fact that an electric field for flying the toner on the developing sleeve to the surface of the photosensitive drum was not generated, thus a large amount of toner deposited on the photosensitive drum by the van der Waals force of the toner or the mirror reflection power and the toner was taken in the charging roller altogether to have caused the toner contamination on the charging roller.

That is, from the above-mentioned results, it is seen that the charging performance can be maintained because a flying amount of the electrically conductive fine particulate matters from the developing sleeve to the surface of the photosensitive drum increases and a large amount of toner does not deposit on the photosensitive drum if the S-D gap is 150 μm or more and 250 μm or less even if electric field intensities for flying the electrically conductive fine particulate matters from the surface of the developing sleeve to the surface of the photosensitive drum are the same.

From the above-mentioned results of the experiments, it is seen that a charging defects can be improved while securing a margin to a leak image because the electrically conductive fine particulate matters can be steadily supplied from the developing apparatus by setting the S-D gap between 150 μm and 250 μm.

[Second Embodiment]

A second embodiment of the present invention will be now described. Further, configurations similar to those of the first embodiment are given reference numerals identical with those in the first embodiment and their descriptions are omitted.

A characteristic of this embodiment is that a photosensitive drum, a charging roller and a developing apparatus are provided altogether inside an integrated cartridge being a replaceable process cartridge.

Figure 4:
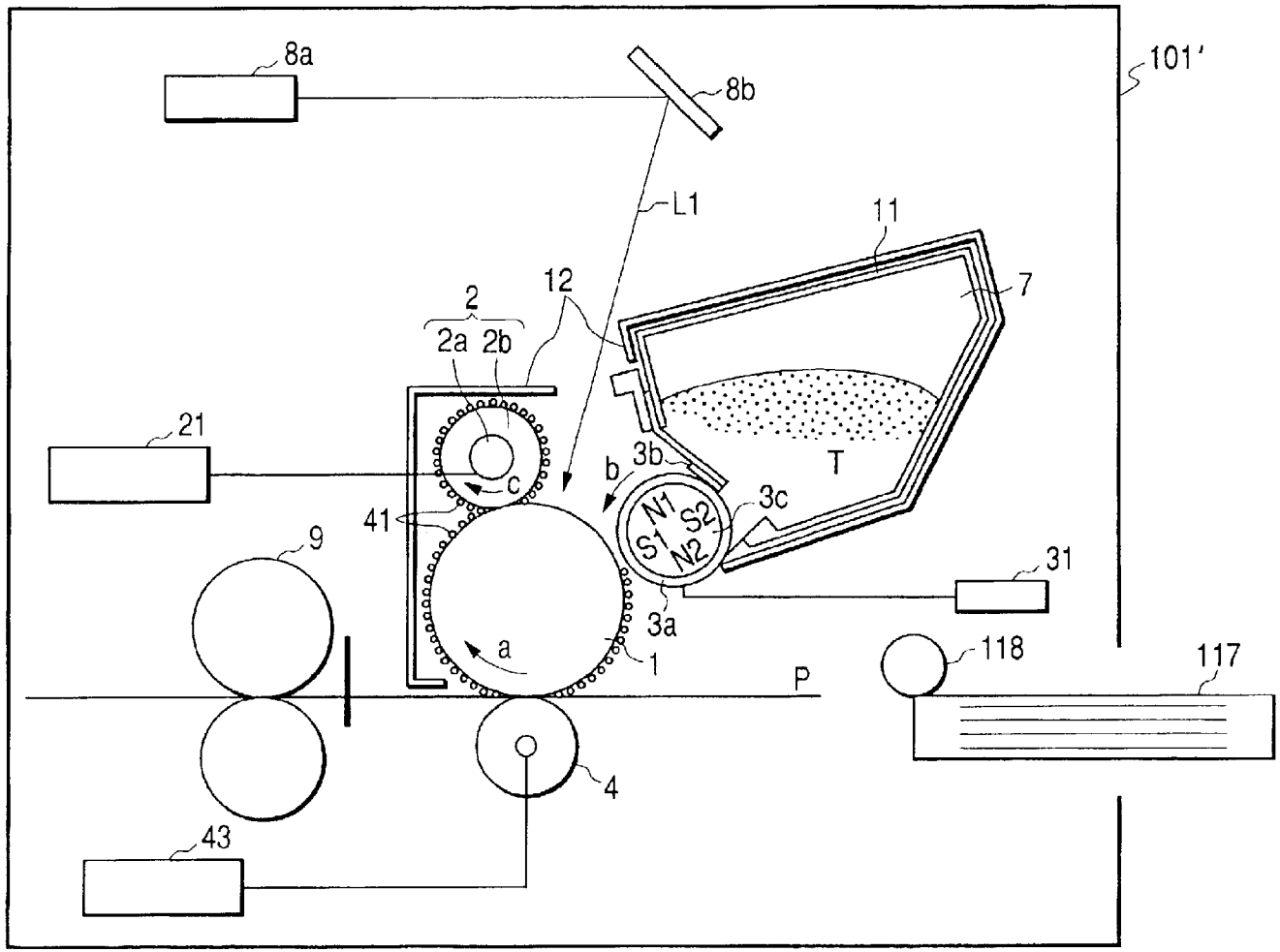
FIG. 4 is a schematic sectional view showing a configuration of an image forming apparatus in accordance with a second embodiment of the present invention.
Figure 5:
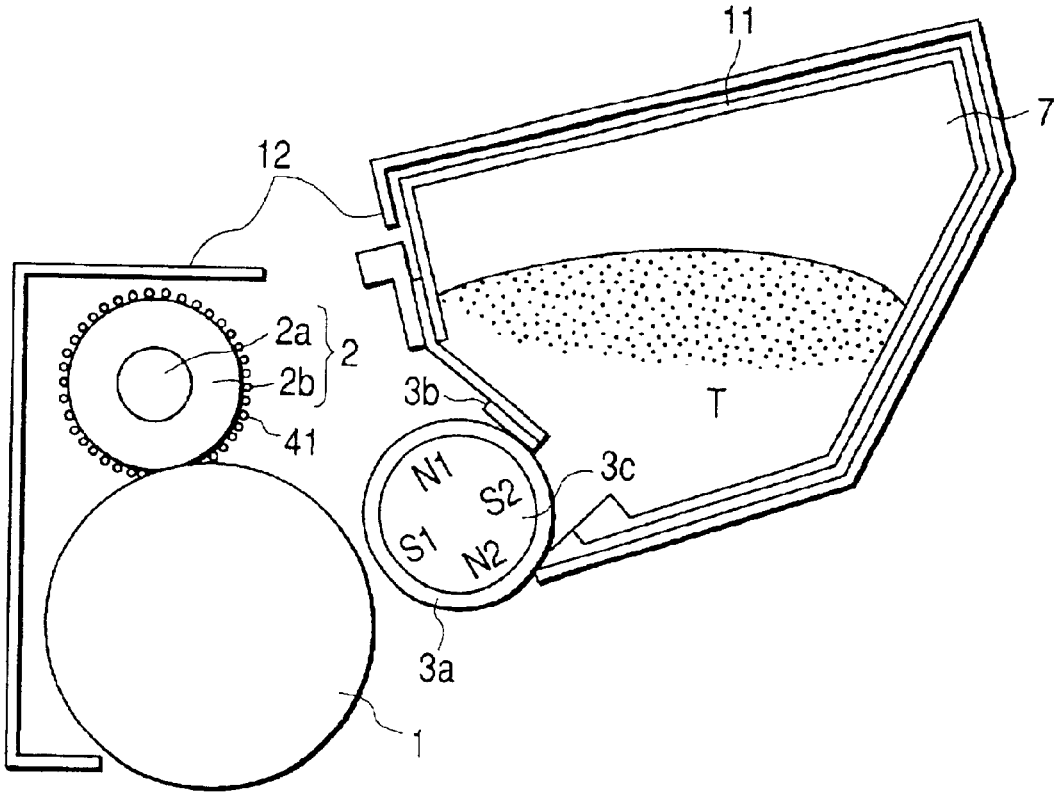
FIG. 5 is a schematic sectional view showing a configuration of a process cartridge provided in the image forming apparatus of FIG. 4.

FIG. 5 is a view showing an example of the integrated cartridge. FIG. 4 is a view showing a situation when the integrated cartridge is inserted in an image forming apparatus main body.

In this embodiment, the photosensitive drum 1, the charging roller 2 and the developing apparatus 11 in which the S-D gap is set at 200 μm are integrated by an exterior 12 to form an integrated cartridge.

This integrated cartridge is designed such that, when the toner T is exhausted, the other apparatuses end their lives almost simultaneously. Therefore, there are advantages in that a user can always obtain a stable image while toner remains in the cartridge and that, since the cartridge is an integrated type, it can be easily replaced.

Further, by setting the S-D gap in this integrated cartridge within optimal values, there is an advantage in that a charging defect is improved in addition to the advantages inherent in the integrated cartridge.

[Third Embodiment]

A third embodiment of the present invention will now be described. Further, configurations similar to those in the first embodiment are given reference numerals identical with those in the first embodiment and their descriptions are omitted.

Figure 6:
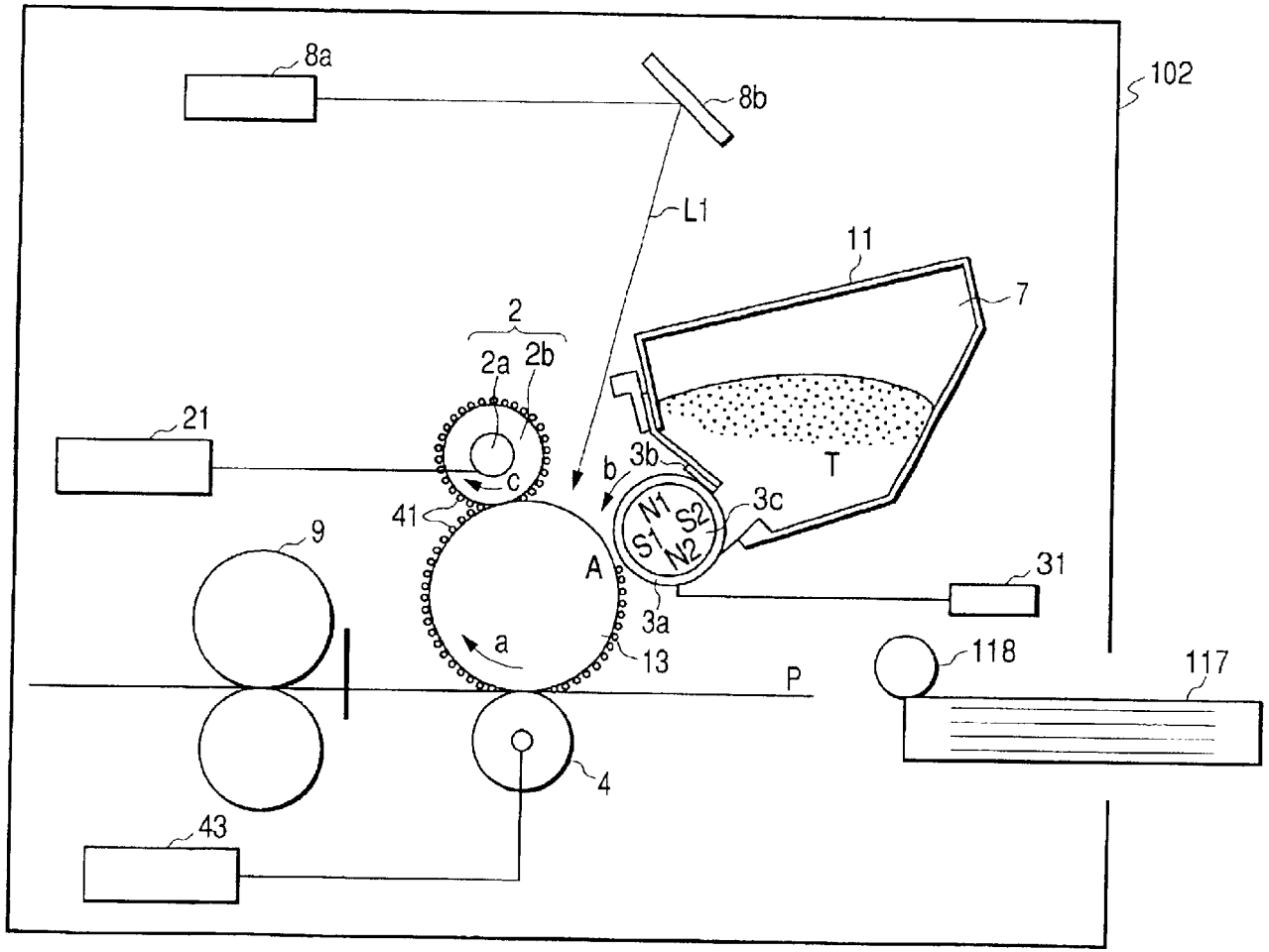
FIG. 6 is a schematic sectional view showing a configuration of an image forming apparatus in accordance with a third embodiment of the present invention.

FIG. 6 is a schematic sectional view showing a configuration of an image forming apparatus in accordance with this embodiment.

This embodiment is for more steadily performing charging uniformly by adjusting a surface resistance of a photosensitive drum being a latent image bearing member in the first embodiment.

That is, this embodiment is for exchanging charges more efficiently by the existence of electrically conductive fine particulate matters and by setting a surface resistance on a photosensitive body side low in a region where a latent image can be formed even if transfer residual toner is mixed in the charging roller 2 and an area of the charging roller 2 contacting the photosensitive drum 13 is reduced.

In this embodiment, the resistance on the surface of the photosensitive drum is adjusted by providing a charge injection layer on the surface of the photosensitive drum 13.

Figure 7:
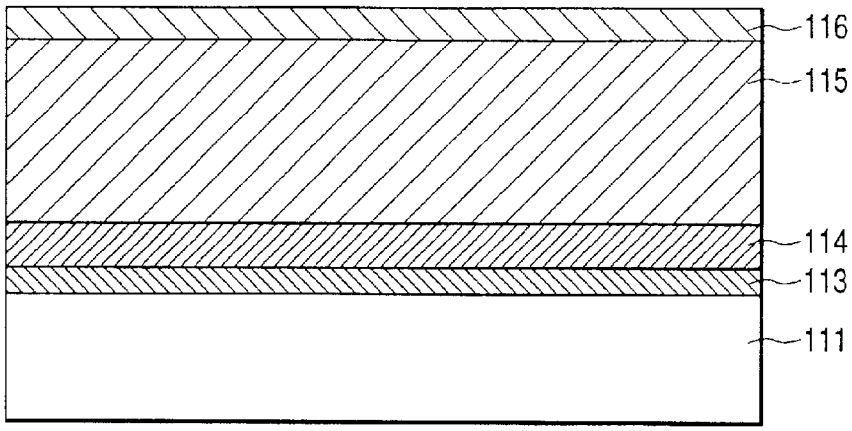
FIG. 7 is a partially enlarged sectional view of a latent image bearing member provided in the image forming apparatus of FIG. 6.

FIG. 7 is a view of a layer configuration model of the photosensitive drum 13, on which surface the charge injection layer is provided, used in this embodiment.

As shown in FIG. 7, the photosensitive drum 13 is formed by applying a charge injection layer 116 on a general organic photosensitive drum that is formed by overlapping and applying a positive charge injection preventing layer 113, a charge generating layer 114 and a charge transporting layer 115 in this order on an aluminum drum base body (A1 drum base body) 111, whereby the charging performance is improved.

The charge injection layer 116 is formed as a film by a photo-hardening method after mixing and dispersing smoothing agents and polymerization starting agents or the like such as $SnO_2$ ultra-fine particles 116*a* (with the diameter of approximately 0.03 $\mu$m) as electrically conductive particles (electrically conductive filler) and tetrafluoride ethylene resin (whose product name is Teflon) to apply them on acrylic resin of a photo-hardening type as a binder.

What is important with the charge injection layer 116 is a resistance of a surface layer. In a charging method by direct injection of charges, the charges can be exchanged more efficiently by decreasing a resistance on a charged body side. On the other hand, if the charge injection layer 116 is used as a photosensitive body, it is necessary to hold an electrostatic latent image for a fixed time. Thus, the range of $1\times10^9$ to $1\times10^{14}$ ($\Omega$cm) is appropriate as a volume resistance value of the charge injection layer 116.

In addition, even in the case in which the charge injection layer 116 is not used as in the configuration of this embodiment, an equivalent effect can be obtained if, for example, the charge transporting layer 115 is within the above-mentioned resistance range.

Moreover, a similar effect can also be obtained using an amorphous silicon photosensitive body that has a volume resistance of a surface layer of approximately $10^{13}$ $\Omega$cm.

Figure 8:
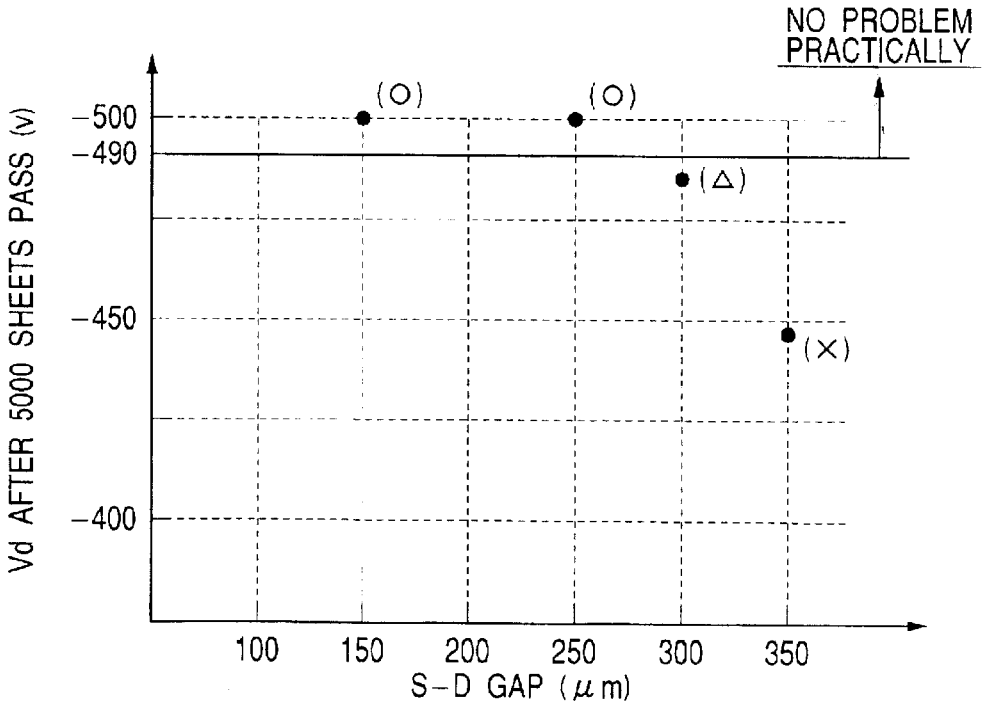
FIG. 8 is a graph showing a relation between a distance of the surface of the latent image bearing member and the surface of the developer carrying member (S-D gap) and a charging potential ($V_d$) on the surface of the latent image bearing member by a charging member in the third embodiment of the present invention.

FIG. 8 shows results of experiments similar to those in the first embodiment using the image forming apparatus shown in FIG. 6 arranged in a graph. Further, in this embodiment, an experiment was not performed for the S-D gap of 100 $\mu$m because there was a situation in which toner coated on the developing sleeve 3*a* contacted the surface of the photosensitive drum in the S-D gap of 100 $\mu$m.

From FIG. 8, it is seen that the $V_d$ maintenability is improved as a whole and the charging performance is increased in this embodiment compared with the experimental results of the first embodiment. In particular, $V_d$ was perfectly maintained between the S-D gaps of 150 $\mu$m and 250 $\mu$m, and a charging defect did not occur at all. That is, the charging efficiency can be increased by providing a charge injection layer on a surface of a photosensitive drum to realize optimization of its surface resistance.

Therefore, the S-D gap is set at 150 $\mu$m or more and 250 $\mu$m or less and a surface resistance of a photosensitive drum is set in a range of $1\times10^9$ to $1\times10^{14}$ ($\Omega$cm) to steadily supply electrically conductive fine particulate matters from a surface of a developing sleeve to the surface of the photosensitive drum and further improve a charge injection property. Thus, the charging efficiency is further improved and occurrence of a charging defect can be prevented.

As described above, according to the invention in accordance with this application, stabilization of the supply of electrically conductive particles from developing means to a charging member via an image bearing member can be realized, and a charging defect of a latent image bearing member due to insufficient electrically conductive particles on the charging member can be improved.

As many apparently widely different embodiments of the present invention can be made without departing from the spirit and scope thereof, it is to be understood that the invention is not limited to the specific embodiments thereof except as defined in the appended claims.

What is claimed is:

1. An image forming apparatus comprising:

an image bearing member;

a charging member for charging said image bearing member, the charging member bearing electrically conductive particles that contact said image bearing member; and a developer carrying member for carrying a developer provided with toner and electrically conductive particles, said developer carrying member being applied a voltage to develop an electrostatic image formed on said image bearing member with the developer and being capable of collecting a residual developer on said image bearing member, wherein said developer carrying member opposes said image bearing member with a gap of from 150 $\mu$m to 250 $\mu$m therebetween so as to enable the electrically conductive particles to fly from said developer carrying member to said image bearing member via the gap.

2. An image forming apparatus according to claim 1, wherein said electrically conductive particles have a particle resistance of $10^{-1}$ $\Omega$cm or more and $10^{12}$ $\Omega$cm or less and a particle diameter of 0.5 $\mu$m or more and 10 $\mu$m or less.

3. An image forming apparatus according to claim 1, wherein said electrically conductive particles are charged to have a reverse polarity with respect to the toner on said developer carrying member.

4. An image forming apparatus according to claim 1, wherein said charging member forms a nip portion between said charging member and said image bearing member, and the electrically conductive particles are caused to intervene in the nip portion.

5. An image forming apparatus according to claim 4, wherein said charging member is capable of moving at a peripheral velocity different from a peripheral velocity of said image bearing member in the nip portion.

6. An image forming apparatus according to claim 4, wherein a moving direction of the surface of said charging member is opposite to a moving direction of the surface of said image bearing member in the nip portion.

7. An image forming apparatus according to claim 1, wherein said image bearing member is provided with a surface layer of a volume resistance of from $10^9$ Ωcm to $10^{14}$ Ωcm.

8. An image forming apparatus according to claim 1, wherein said charging member injects a charge to charge said image bearing member without substantial discharge between said charging member and said image bearing member.

9. An image forming apparatus according to claim 1, wherein said developer carrying member is capable of performing an operation of collecting the residual developer from said image bearing member while simultaneously performing a developing operation.

10. An image forming apparatus according to claim 1, wherein the voltage is applied to said developer carrying member to form an electric field for causing a developer to fly from said developer carrying member to said image bearing member.

11. An image forming apparatus according to claim 1, wherein a voltage is applied to said charging member.

12. An image forming apparatus according to claim 1, further comprising transferring means for transferring a toner image from said image bearing member to a recording medium.

13. An image forming apparatus according to claim 1, wherein said image bearing member, said charging member and said developer carrying member are provided in a process cartridge that is detachably mountable to a main member of said apparatus.

* * * * *

UNITED STATES PATENT AND TRADEMARK OFFICE

CERTIFICATE OF CORRECTION

PATENT NO. : 6,907,211 B2
DATED : June 14, 2005
INVENTOR(S) : Masahiro Yoshida et al.

It is certified that error appears in the above-identified patent and that said Letters Patent is hereby corrected as shown below:

Column 5,
Line 36, “as a” should read -- as an --.
Line 49, “te” should read -- the --.

Column 7,
Line 27, “conducive” should read -- conductive --.

Column 8,
Line 4, “conducive” should read -- conductive --.

Column 10,
Line 49, “describe” should read -- described --.

Column 11,
Line 17, “a electrically” should read -- an electrically --.

Signed and Sealed this

Thirteenth Day of June, 2006

JON W. DUDAS
*Director of the United States Patent and Trademark Office*